US005796025A

United States Patent [19]

Haake

[11] Patent Number: 5,796,025

[45] Date of Patent: Aug. 18, 1998

[54] FIBEROPTICALLY ILLUMINATED ELECTRIC STRINGED MUSICAL INSTRUMENT

[76] Inventor: John M. Haake, 5 Gumtree Pl., St. Charles, Mo. 63301-1296

[21] Appl. No.: 571,587

[22] Filed: Dec. 13, 1995

[51] Int. Cl.[6] ..... G10D 1/00

[52] U.S. Cl. ..... 84/464 R; 84/464 A; 84/477 R

[58] Field of Search ..... 84/464 R, 464 A, 84/477 R, 267, 293; 362/32

[56] References Cited

U.S. PATENT DOCUMENTS

| | | |
|---|---|---|
| 3,324,755 | 6/1967 | Canonico . |
| 3,854,370 | 12/1974 | Sapinski . |
| 3,943,815 | 3/1976 | Gilbert . |
| 3,958,113 | 5/1976 | Termohlen . |
| 4,236,191 | 11/1980 | Martinez . |
| 4,563,933 | 1/1986 | Kim . |
| 4,704,941 | 11/1987 | Reilly . |
| 4,890,529 | 1/1990 | Grant . |

*Primary Examiner*—Jonathan Wysocki
*Assistant Examiner*—Marlon T. Fletcher
*Attorney, Agent, or Firm*—Polster, Lieder, Woodruff, & Lucchesi, L.C.

[57] ABSTRACT

A fiberoptically illuminated electronic stringed musical instrument is disclosed that has at least one pickup. At least one light source is disposed within the body of the instrument. A plurality of optical fibers are embedded in the instrument such that each fiber extends from the light source to a predetermined location on the exterior surface of the instrument. The fibers provide a transmission path for the light rays emitted by the light source, thereby illuminating the exterior surface of the instrument while at the same time the fiber becomes part of the mechanical/composite structure of the guitar. Control circuitry, disposed within the body of the instrument, is connected to the pickup and the light source. The control circuitry selectively controls the illumination of the light source, and therefore the exterior surface of the instrument, based upon electrical signals generated by the pickup.

20 Claims, 13 Drawing Sheets

FIBEROPTICALLY ILLUMINATED ELECTRIC STRINGED MUSICAL INSTRUMENT

BACKGROUND OF THE INVENTION

This invention relates to musical instruments, and in particular to a stringed electric musical instrument such as an electric guitar or bass that is illuminated by at least one light source disposed within the body of the musical instrument via a plurality of optical fibers embedded in the musical instrument.

During concerts or other musical performances, many types of visual effects are often utilized as an accompaniment to the music to enhance the pleasure and enjoyment experienced by an audience. To achieve this goal, guitar and bass manufacturers are frequently changing the shape, accessories, color, pictures and finishes of the instrument to make the instrument as aesthetically desirable as possible for the musician and the audience. However, when the guitars are played in a dark or dim environment or in a large venue, many of these features and decorations are not visible to the audience. Therefore, guitars and basses have been developed that may also be illuminated to provide additional visual stimulation for the audience.

For example, U.S. Pat. No. 4,563,933, issued Jan. 14, 1986 to Kim, sets forth a hollow body guitar that produces visual and sequential lighting effects on the guitar body. A multiplicity of small light sources are mounted on the exterior surface of the body. The illumination of these light sources is controlled by electronic circuitry and associated mercury tilt switches hidden within the guitar body to provide circular, sequential, and/or pulsed lighting effects.

The illuminated guitar described in U.S. Pat. No. 4,236,191, issued Nov. 25, 1980 to Martinez, includes grooves formed in the surface of a hollow body guitar which follow the shape of the guitar. A plurality of fiberoptics are disposed in the groves and overlaid with a veneer such that the individual fibers extend through apertures formed in the veneer overlay. The other ends of the fibers are bundled together into a trunk line that extends from the guitar to an external remote source of illumination including a light source such as a conventional light bulb. The color of the light transmitted by the fiberoptics varies by providing a color wheel between the light source and the fiberoptics that rotates due to the heat generated by the light source.

A third embodiment of an illuminated guitar is set forth in U.S. Pat. No. 3,943,815, issued on Mar. 16, 1976 to Gilbert. In the Gilbert patent, strands of fiberoptics are disposed in a channel extending from a hollowed-out portion containing a light source in the guitar body to a predetermined location on the neck. The fiberoptic strands are then inserted into holes drilled through the fretted surface of the neck to the channel. As long as the light source is turned on, the fretted surface of the neck is illuminated via the fiberoptic strands.

Other patented inventions relating to illuminated musical instruments include U.S. Pat. No. 4,890,529 issued Jan 2, 1990 to Grant; U.S. Pat. No. 4,704,941 issued Nov. 10, 1987 to Reilly; U.S. Pat. No. 3,958,113 issued May 18, 1976 to Termohlen; U.S. Pat. No. 3,854,370 issued Dec. 17, 1974 to Sapinski; and U.S. Pat. No. 3,324,755 issued Jun. 13, 1967 to Canonico.

However, many of the illuminated systems and methods disclosed in these patents can only be used in conjunction with stringed musical instruments having a hollow body construction. Such systems are not readily adapted to instruments having a solid body construction, such as an electric guitar or bass. The illumination systems and methods currently used for solid body instruments often require special manufacturing processes that require expensive retooling. In addition, when a plurality of individual light sources are individually mounted on the exterior surface of a guitar. The manufacturing of this guitar is cost prohibitive due to all many electrical leads which have to be routed and then connected to the control circuitry and repair of these light sources if they break or burn out results in additional expense as well as having the instrument out of service for a period of time. When fiberoptics are presently used to illuminate the instrument, special handling procedures are typically employed to prevent the fiberoptic strands from breaking during the manufacturing process. Faceting of the fiberoptics is often time consuming and expensive since special cleaving processes must be performed on each fiberoptic so that light can be efficiently transmitted from the light source across the individual fiberoptic facets. Illuminated guitars requiring an external remote light source and wiring are more cumbersome to operate and restrict the musician's range of movement on stage, and are prone to failure or breakage. In summary, fiberoptically illuminated guitars as described in the above patents are constructed such that the fiberoptics are not attached along their length to the body of the guitar, so that they are prone to breakage and cannot contribute to the mechanical integrity of the guitar.

SUMMARY OF THE INVENTION

Accordingly, one object of the present invention is to provide a new and improved illuminated stringed electrical musical instrument having a solid body construction.

Another object of this invention is to provide a stringed musical instrument that has an illuminated decorative designed on its body and/or fretboard which is aesthetically pleasing and allows a musician to play in a dimly lit or dark environment.

Another object of this invention is to provide a stringed musical instrument that is illuminated by a plurality of fiberoptics extending from at least one light source hidden in the body of the instrument.

Another object of this invention is to provide a stringed musical instrument wherein the illumination of the light source is controlled by electrical circuitry in the body of the instrument based on electrical signals generated by at least one pickup.

Another object of this invention is to provide an illuminated stringed musical instrument that has a plurality of fiberoptics embedded into the wood of the neck and body to form a composite material that is sufficiently durable to withstand normal manufacturing processes and protects the fiberoptics against breakage.

Another object of this invention is to provide an illuminated stringed musical instrument that has a plurality of fiberoptics embedded into the wood of the neck and body to form a solid composite material that is close to the mechanical stiffness of the wood of the guitar.

Still another object of this invention is to provide an illuminated stringed instrument wherein the fiberoptics embedded into the wood are faceted during normal manufacturing processes.

Another object of this invention is to provide an illuminated stringed musical instrument that has various areas of the fretboard and/or neck simultaneously illuminated by differing colors.

Yet another object of this invention is to provide an illuminated stringed musical instrument that requires no special procedures to maintain or repair the guitar.

Still another object of this invention is to provide an illuminated stringed musical instrument that is stand-alone and contains at least one light, light-control electronics, battery, and normal guitar electronics, along with at least one pickup and which requires no external devices.

These and other objects will become apparent to those skilled in the art in light of the following disclosure and accompanying drawings.

In accordance with the invention, generally stated, a stringed musical instrument is disclosed that includes a body, a neck, and at least one electrical pickup. At least one light source is disposed within the body of the musical instrument. Control circuitry is housed within the body of the musical instrument. The circuitry is connected to the pickup and the light source, for selectively controlling the illumination of the light source based upon the electrical signal generated by the pickup. A plurality of optical fibers are embedded within said musical instrument. Each fiber has a first end disposed in close proximity to the light source, and a second end positioned a predetermined location on an exterior surface of the musical instrument. The fibers provide a transmission path for the light emitted from the light source to the exterior surface of the musical instrument and are embedded in the instrument to form a composite structure providing strength to the instrument.

Another aspect of the present invention is of an electric guitar that has an opaque body with a top surface and a bottom surface. A neck extends outwardly from the body. The neck has an interior surface with a longitudinal groove formed therein and an exterior surface. An opaque fretboard having an exterior surface and an interior surface is mounted on the interior surface of the neck. The fretboard has a plurality of holes formed therein extending inwardly from the exterior surface to interior surface. At least one light source is disposed within said body. A plurality of optically conductive fibers are embedded in the guitar neck, thus forming a composite material that does not degrade the mechanical properties of the neck. Each fiber extends through one of the holes in the fretboard, along the groove in said neck and through the body, terminating in close proximity to the light source such that each fiber transmits light emitted by the light source to the exterior surface of the fretboard. The voids between the fiberoptics and in the groove are filled with epoxy or other suitable glue to both hold the fiberoptics in place and to provide a composite structure which adds strength to the guitar neck. At least one pickup disposed within the body. Control circuitry is disposed inside a cavity formed in the body. The control circuitry is connected to the light source and the pickup. The control circuitry controls the illumination of the light source based upon electric signals generated by the pickup.

A third aspect of the present invention is that of a method for illuminating an electric guitar having a body, at least one electrical pickup mounted to the body, a neck extending outwardly from the body, and a fretboard secured to and supported by the neck, comprising the steps of:

disposing a plurality of optical fibers along predetermined paths extending from a cavity formed in the body of the guitar to predetermined locations on an exterior surface of the electric guitar;

mounting a light source inside the cavity in close proximity to the fibers; and providing means for selectively illuminating the light source based on the electric signal generated by the pickup to thereby illuminate the exterior surface of the guitar via the optical fibers.

A fourth aspect of the present invention is that of a method for illuminating an electric guitar having a body including a top portion and a bottom portion, at least one electrical pickup, a neck extending outwardly from said body, and a fretboard secured to and supported by said neck, comprising the steps of:

drilling a first set of holes between an exterior surface and interior surface of the top portion of the guitar body in a random or predetermined pattern;

drilling a second set of holes between an exterior surface and interior surface of the fret board;

threading an optically conductive fiber through each of the first and second sets of holes;

securing the fibers within each hole;

gathering the fibers extending through the first set of holes into a bundle at a future location of a cavity in the body;

gluing the fibers extending through the first set of holes to the interior surface of the top portion;

placing the second set of fibers in a groove formed in the neck of the guitar as the neck and fretboard are secured together and filling the voids between the fibers and the groove with epoxy;

placing the second set fibers extending from a base of neck into a channel formed in an interior surface of the bottom portion of the body that extends from the base of the neck to the future location of the cavity in the body;

bonding the interior surfaces of the top and bottom portions together while at the same time filling the voids in the grooves containing the fiberoptics;

routing out the cavity through the bottom portion into the top portion, which is a standard procedure for normal solid body guitar construction;

terminating and faceting a first end of each fiber embedded within the body of the guitar when the cavity is routed out;

terminating and faceting a second end of each fiber extending outwardly from the top portion and fretboard by sanding or machining the exterior surface of the guitar to obtain a smooth shaped exterior surface;

continuing with normal solid body guitar manufacturing techniques, such as those familiar to those skilled in the art of guitar making;

mounting at least one light source inside the cavity in close proximity to the terminated fibers; and mounting light source control circuitry inside the cavity and connecting input terminals for the control circuitry to the electrical pickup and output terminals for the control circuitry to the light source whereby the control circuitry controls the illumination of the light source based upon the electric signal generated by the pickup.

Other objects and features will be apparent and in part pointed out hereinafter.

BRIEF DESCRIPTION OF THE DRAWINGS

The objects of the invention are achieved as set forth in the illustrative embodiments shown in the drawings which form a part of the specification.

FIG. 8 is a top view of the neck and bottom portion of the body of a fiberoptically illuminated guitar illustrating the location of the fibers used to illuminate the fretboard (not shown) when the guitar is assembled using a through neck construction;

Corresponding reference characters indicate corresponding parts throughout the several views of the drawings.

DESCRIPTION OF THE PREFERRED EMBODIMENT

Figure 1B:
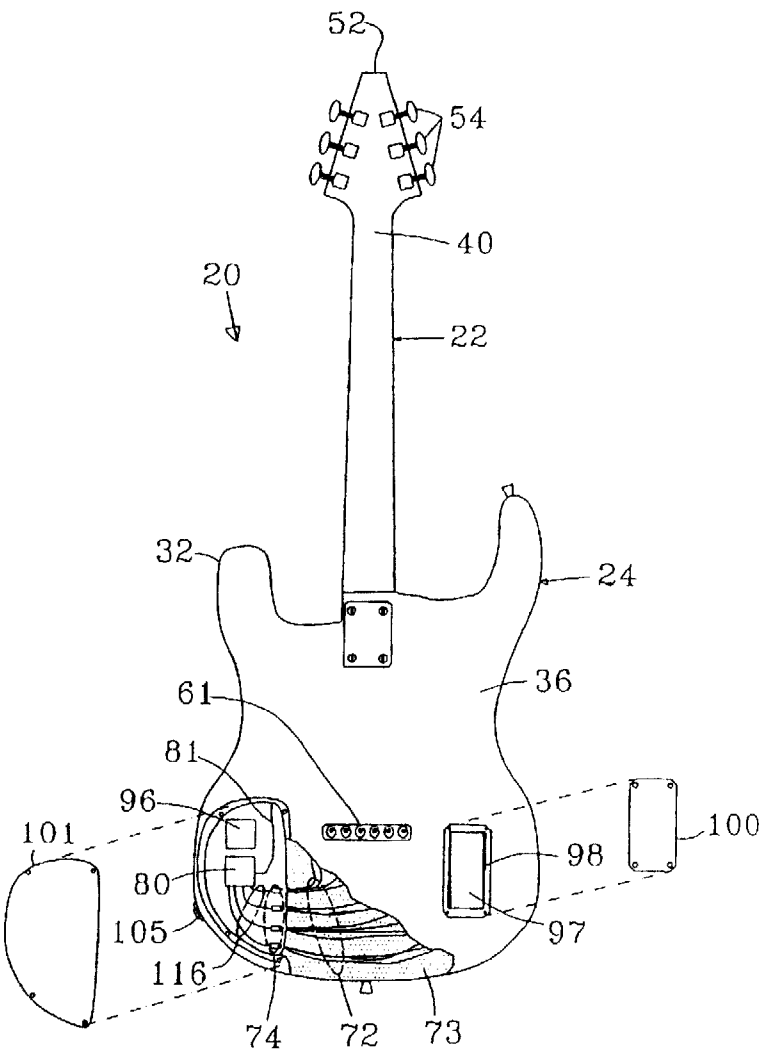
FIG. 1B is a bottom plan view of the fiberoptically illuminated guitar shown in FIG. 1A with the protective shields for the battery cavity and circuitry cavity exploded to illustrate the contents of the cavities (before the voids are filled with epoxy to form a composite structure), and a segment of the bottom portion of the body removed to illustrate the fiberoptic bundles used to illuminate the top portion of the body.
Figure 1A:
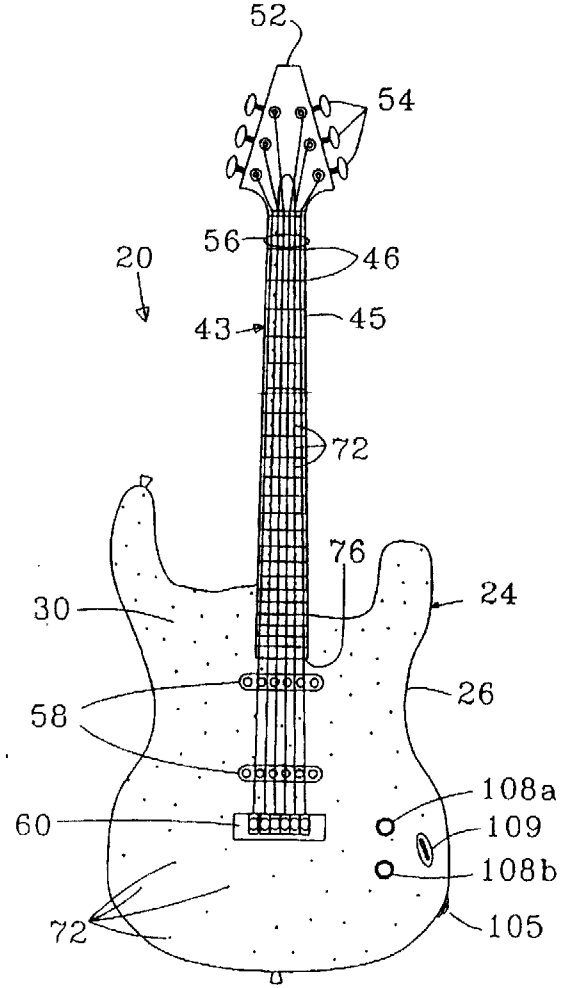
FIG. 1A is a top plan view of a fiberoptically illuminated guitar of my present invention illustrating a random or predetermined distribution of light emitting optical fibers in the body and neck of the guitar forming a composite structure.
Figure 4:
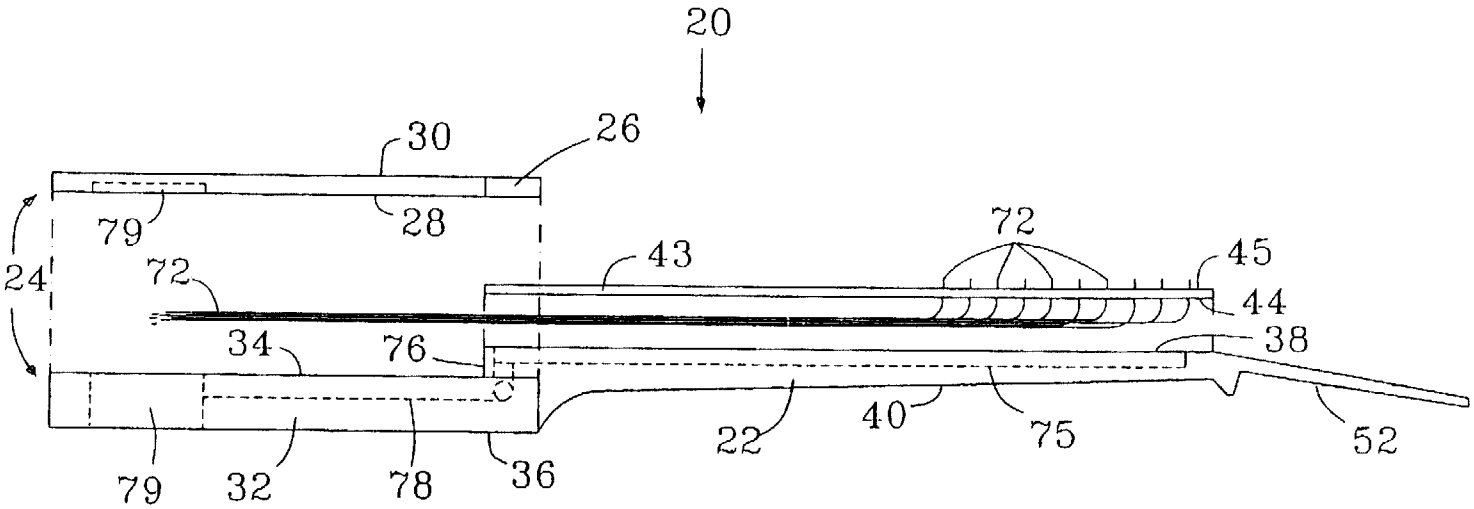
FIG. 4 is an exploded side view of the fiberoptically illuminated guitar of the present invention having a plurality of fibers extending through the fretboard (before the voids are filled with epoxy to form a composite structure)

Referring now to FIGS. 1A, 1B, and 4, there is shown an electric guitar or bass, indicated generally at 20, having a standard solid body construction. A solid body guitar typically includes two main wooden components, namely a neck 22 which extends outwardly a body 24. The body 24 typically includes a top portion 26 having an interior surface 28 and an exterior surface 30, and a bottom portion 32 having an interior surface 34 and an exterior surface 36. Upon assembly of the guitar 20, the interior surfaces 28, 34 of the top and bottom portions 26, 32 are secured, laminated, cemented or glued together.

The neck 22 has an interior surface 38 and an exterior surface 40. A fretboard 43 having an interior surface 44 and an exterior surface 45 is mounted on the neck 22 such that the interior surfaces 44, 38 of the fretboard 43 and the neck 22 are secured together. The fretboard 43 is separately machined using standard guitar manufacturing processes that are well known to those skilled in the art such that a plurality of fret wires 46 are transversely disposed within slots formed at predetermined locations along the length of the exterior surface 45 of the fretboard 43. Any suitable wood may be used to construct the fretboard 43 which is resistant to human sweat, oils and acids such as rosewood, ebony, walnut or maple or any other wood known to those skilled in the art.

The neck 22 also includes a peghead or headstock 52 at its outermost end where tuning machines (or pegs) 54 are installed. Each tuning machine 54 controls the tension of one of a plurality of strings 56 attached thereto. A steel truss rod 57 (FIG. 6*a*) having adjustable tension is typically embedded in the neck 22 to strengthen the neck. The truss rod 57 helps counteract potential warping of the neck 22 due to climatic variations and/or the tensile forces exerted on the strings 56.

Figure 2:
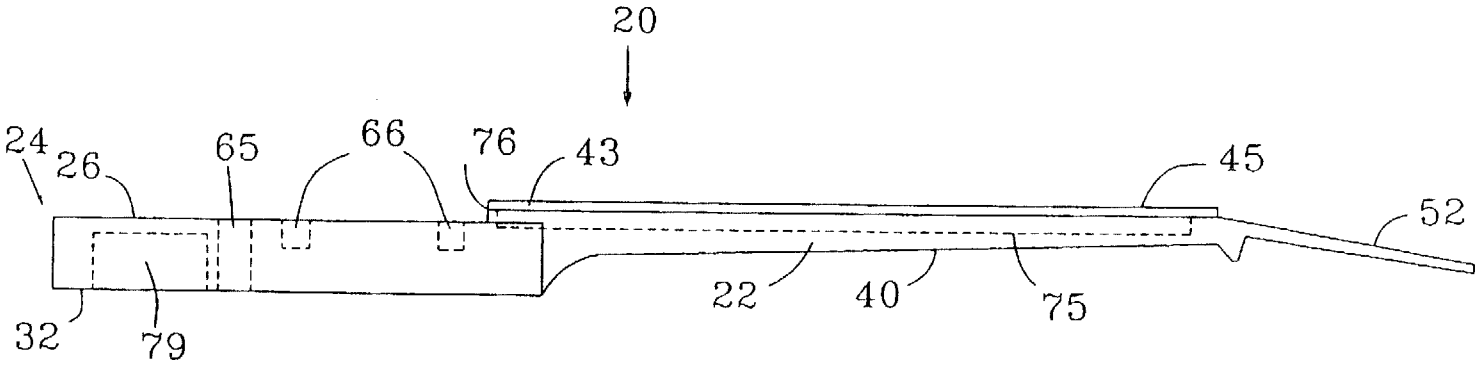
FIG. 2 is a side view of the fiberoptically illuminated guitar illustrating in phantom a plurality of internal cavities and channels formed in the neck and body of the guitar (before the voids are filled with epoxy to form a composite structure)

The strings 56 extend from the tuning machines 54, across one or more electrical pickups 58 (two pickups 58 are shown) and a bridge 60 mounted on a top surface 30 and connected the body 24 to the bridge. As seen from the back is the string 56. Threading holes 61 extend from back surface 36 of body 24 to bridge 60 as shown in FIG. 1A. The bridge 60 supports the strings 56, holding them tautly over the pickups 58. FIG. 2 illustrates certain cavities, channels and grooves formed in the guitar for housing various components. The bridge 60 and 61 are disposed in a cavity 65 formed in the body 24 of the guitar 20. Similarly, each electrical pickup 58 is disposed in a pickup cavity 66. The pickups 58 may be any suitable mechanoelectrical transducers which are actuated by modulation of the strings 56 and transform this mechanical input into an electric output signal. For example, an electromagnetic device including a single wire coil wound around a magnet can be used as a pickup 58. The type of magnet and the manner in which the wire is wound impact on the tone of the guitar 20. Piezoelectric, crystal, fiberoptic or phonograph pickups can also be used. As will be discussed in more detail below, as the strings 56 move across the magnetic field generated by the pickups 58, the pickups 58 convert the oscillations or vibrations of the strings 56 into electrical signals for subsequent conversion into sound.

Figure 3A:
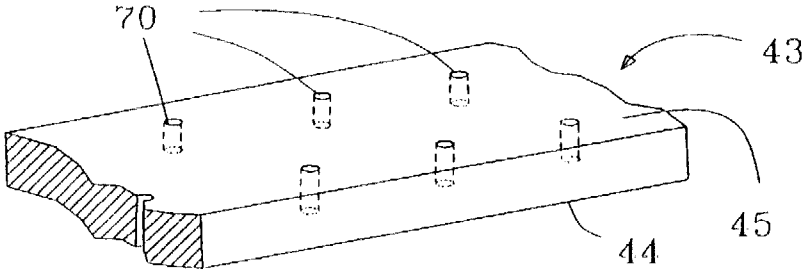
FIG. 3A is a sectional view of a portion of a fretboard having a plurality of holes drilled therein.

The guitar 20 of my present invention also includes a plurality of holes 70 drilled inwardly through the top portion 26 of the body 24 and/or the fretboard 43 such that the holes 70 extend in a perpendicular manner between the interior and exterior surfaces of the fretboard 43 or the top portion 26 of the body 24. FIG. 3A shows a sectional view of a portion of the fretboard 43 having several holes 70 formed therein. The holes 70 can be disposed in either a random or a designed pattern in the fretboard 43 or the top portion 26 of the body 24 (see FIG. 10A). The holes 70 can be drilled in a manufacturing environment using a wire drill, or using a high power laser (e.g., a $CO_2$ or Nd-YAG laser) or water cutting tools on an automated table top.

Figure 3B:
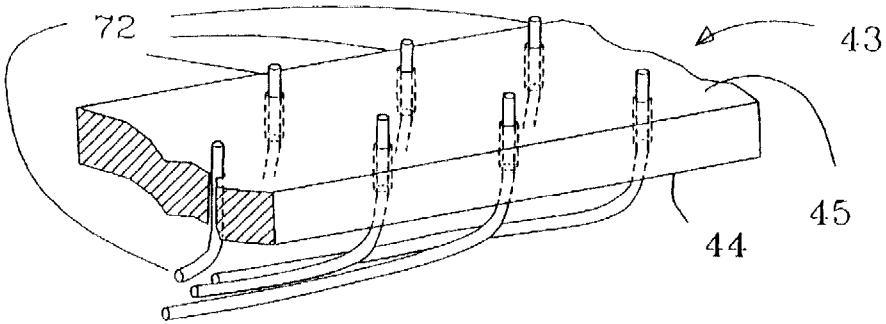
FIG. 3B is a sectional view of the fretboard set forth in FIG. 3A wherein an optical fiber is threaded through each of the holes and glued into each hole.
Figure 3C:
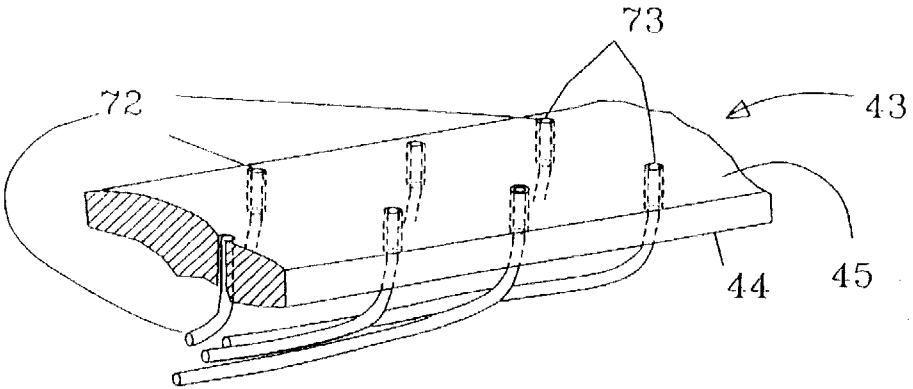
FIG. 3C is a sectional view of the fretboard set forth in FIG. 3B wherein the optical fibers are faceted by the normal manufacturing methods use to shape the fretboard.
Figure 11:
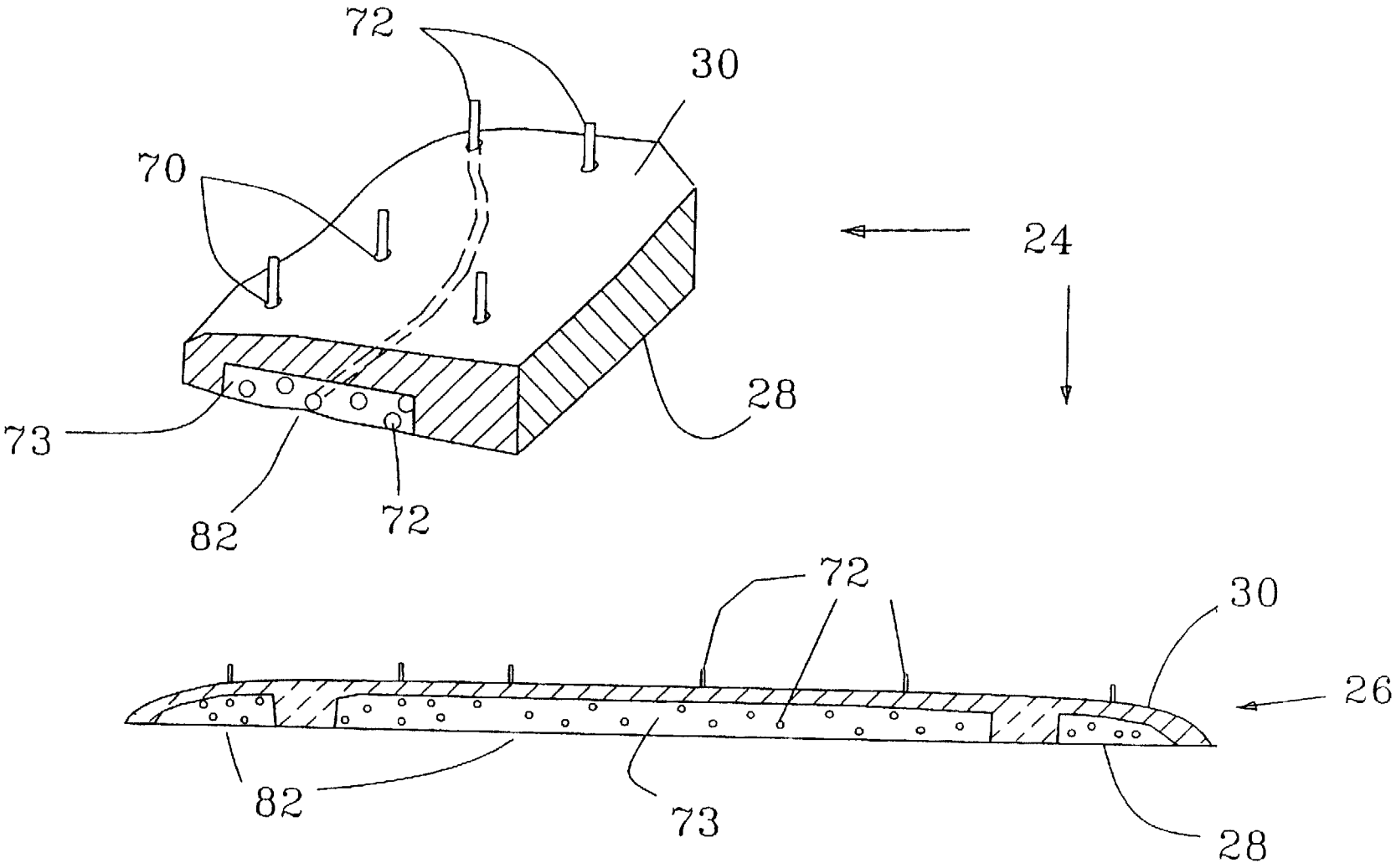
FIG. 11 is a cross sectional view of the fiberoptically impregnated top portion the guitar body set forth in FIG. 10B taken along line 11—11 illustrating a plurality of fibers epoxied within the recess to form a composite structure.

Once the holes 70 are drilled in a random or designed pattern, a plurality of optical fibers or filaments 72, made of dielectric material, are inserted or threaded through the holes 70. FIG. 3B shows the fibers 72 threaded through the holes 70 of the fretboard 43. Similarly, FIG. 11 is a cross-sectional view of a fiberoptically impregnated top portion 26 wherein several fibers 72 are threaded through holes 70 formed therein. The number of fibers 72 employed directly corresponds to the number of holes 70 drilled in the guitar 20. As will be discussed in more detail below, the fibers 72 extend from the holes 70, along either the interior surface 28 of the top portion 26 or the interior surface 44 of the fretboard 43, to a light source 74. The fibers 72 are threaded through the holes 70 from the interior surfaces 28, 44 to the exterior surfaces 30, 45, respectively, such that a portion of each fiber 72 extends outwardly in a perpendicular fashion from the corresponding exterior surfaces 30, 45 (see FIGS. 3B and 11). The fibers 72 are epoxied, glued or clamped along the length of each hole 70 (as indicated by reference numeral 73) such that the fiber 72 protrudes from either the exterior surface 30 of the top portion 26 of the body 24, or the exterior surface 45 of the fretboard 43. As will be discussed below, any fibers 72 protruding from the fretboard 43 are sanded and faceted during the manufacturing process using standard tools used by those of ordinary skill in the art such that the faceted fibers 72 are embedded in the fretboard 43 as shown in FIG. 3C.

Upon assembly, any fibers 72 extending through holes 70 formed in the fretboard 43 are placed in a longitudinal groove or channel 75 formed in the interior surface 38 of a rough wood stock used for the neck 22 of the guitar 20. (In some guitar makes, the truss rod is buried underneath the fret board, while in others it is in back. The first type can have two grooves, while the latter may have only one. The present invention is not limited to any particular number of grooves.) This groove 75 extends from the headstock 52 to a base 76 of the neck 22 as shown in FIGS. 2, 4, 5, and 7–9. First, epoxy or wood glue 73 is generously applied to the interior surfaces 44, 38 of the fretboard 43 and the neck 22, respectively, to fill any voids between the fibers and between the fibers and the groove walls. Then, the fiberoptics 72 are placed into the groove 75 as the interior surfaces 38, 44 of the neck 22 and fretboard 43 are clamped together. As a result, the fiberoptics 72 are epoxied or glued together and secured within the groove 75. After the fretboard 43 is secured to the neck 22, the fibers 72 extend from the groove 75 at a base 76 of the neck 22 as shown in FIG. 4.

The point of termination of the fiberoptics 72 and the placement of the light source(s) 74 used to illuminate the fretboard 43 varies based upon the construction of the neck 22. As is well known to those who are skilled in the art of bass or guitar construction and manufacturing, the neck 22 can be secured to the body 24 of the guitar 20 using either a "bolt on neck" construction (FIGS. 5–7) or a "through neck" construction (FIGS. 8–9).

Figure 5:
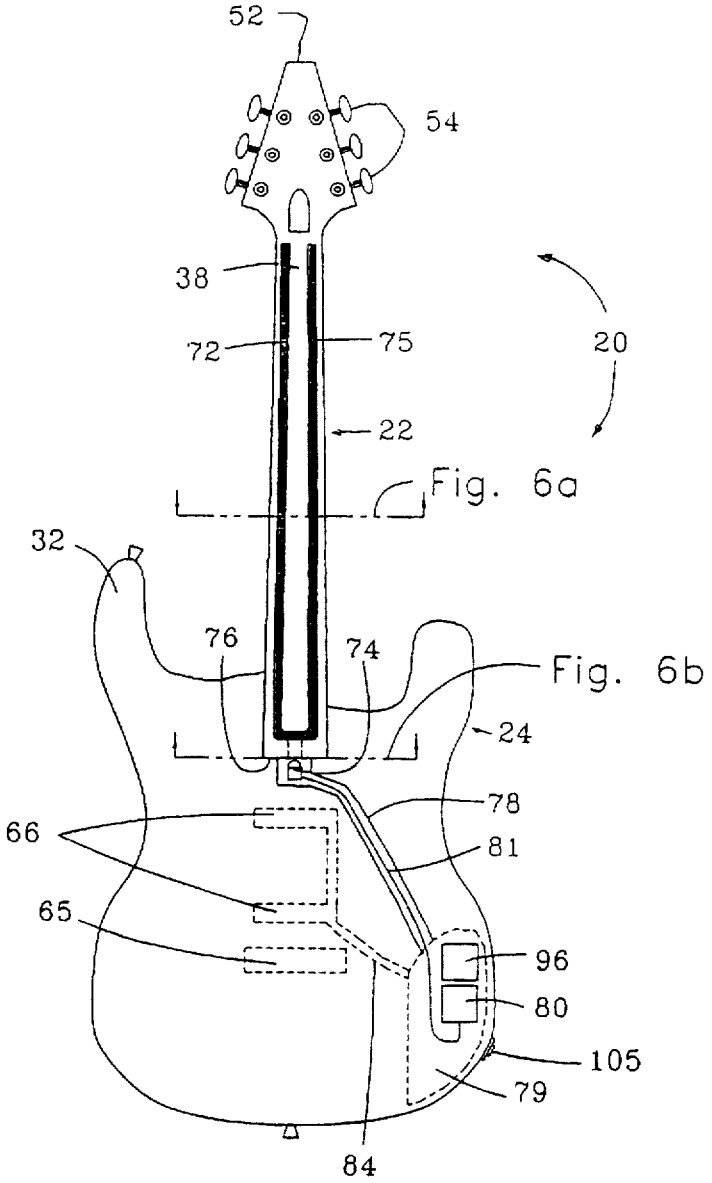
FIG. 5 is a top view of the neck and bottom portion of the body of a fiberoptically illuminated guitar illustrating the location of a light source and associated fibers used to illuminate the fretboard (not shown) when the guitar is assembled using a bolt on neck construction.
Figure 6C:
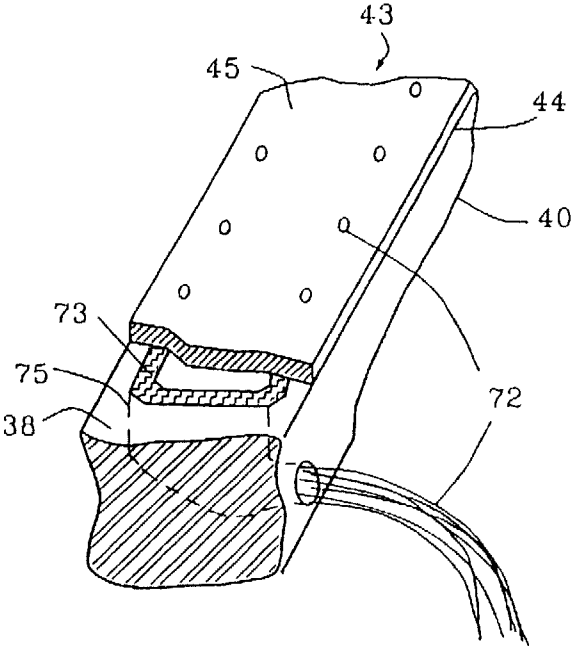
FIG. 6 is a sectional view of the guitar set forth in FIG. 5 wherein the fretboard is secured to the neck to illustrate the termination of the fibers at the base of the neck (before the voids are filled with epoxy to form a composite structure)
Figure 6B:
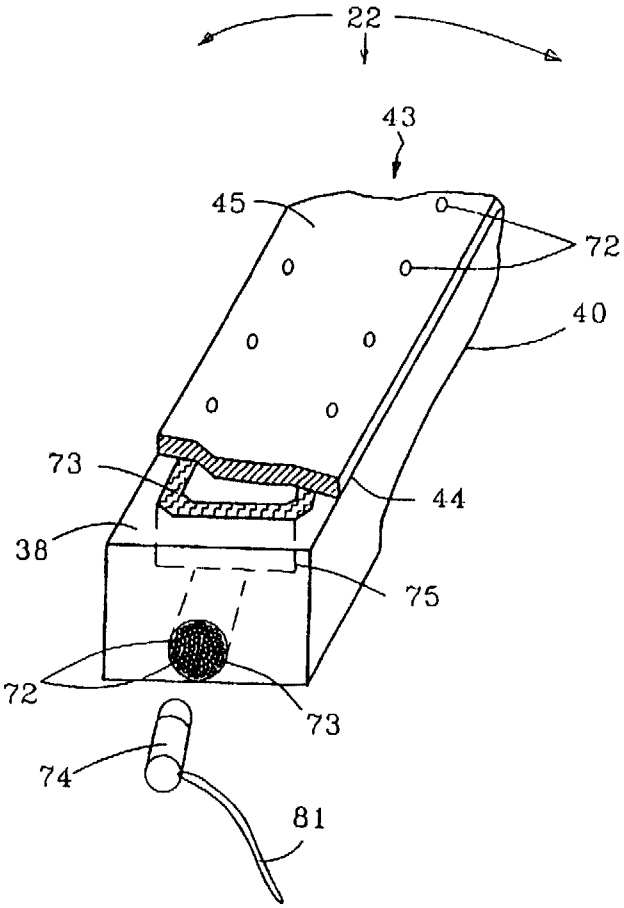
Figure 6A:
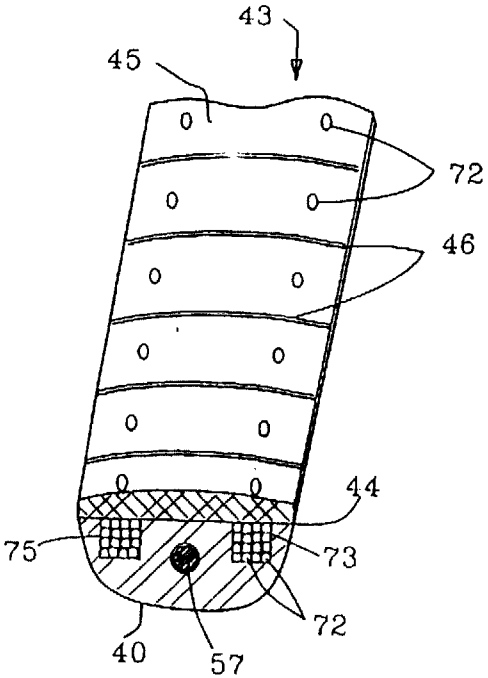
Figure 7:
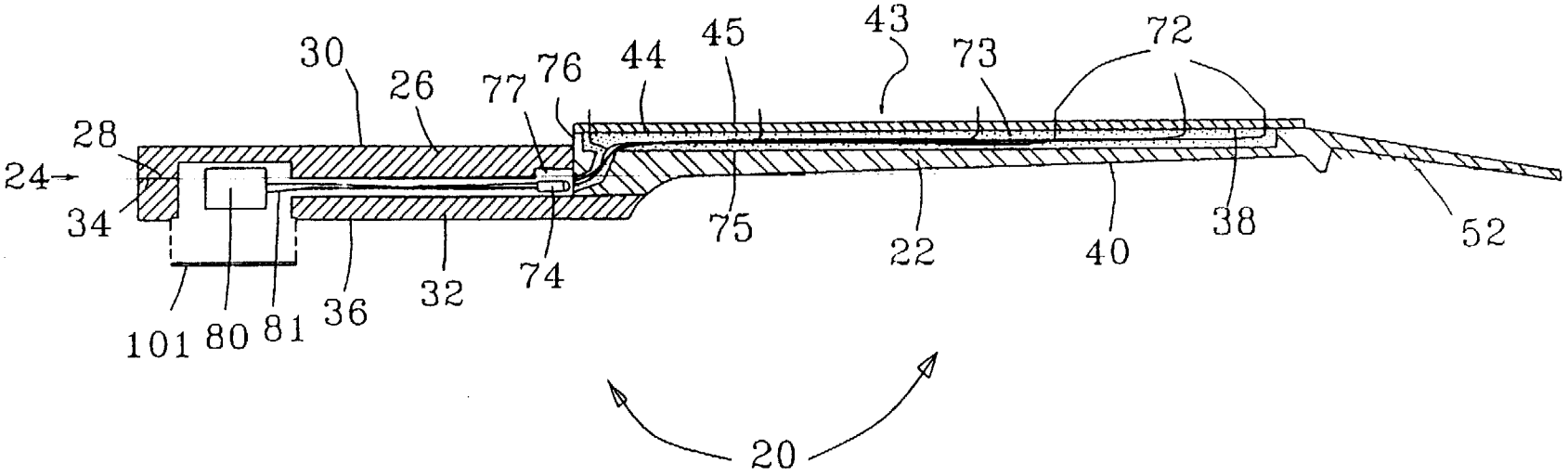
FIG. 7 is a cross sectional view of a fiberoptically illuminated guitar having an illuminated fretboard and a bolt on neck construction.

FIG. 5 is a top of the neck 22 and bottom portion 32 assembled using a bolt on neck construction with the fretboard 43 and top portion 26 removed for illustrative purposes. When using the bolt on neck construction, the fiberoptics 72 extending from the base 76 of the neck 22 are terminated or cut off after the epoxy or glue cures as shown in FIGS. 6–7. The rough wood stock of the neck 22 then is sanded and shaped into a standard neck shape as is well known in the art. The fiberoptics 72 that have been terminated at the base 76 of the neck 22 and those extending from the exterior surface 45 of the fretboard 43 do not require any special treatment. These fiberoptics 72 are sanded, terminated and faceted with the neck 22 and fretboard 43 using standard manufacturing techniques and equipment. After the neck 22 is sanded and shaped, the slots in the exterior surface 45 of the fretboard 43 are fitted with fret wire 46 using standard guitar 20 manufacturing processes. As shown in FIGS. 5 and 7, a light source or bulb 74 located in a cavity 77 formed in the body 24 or the guitar 20 is butted up to the faceted fiberoptic bundle 72 such that each fiber 72 transmits or guides light rays emitted by the light source 74 to illuminate the exterior surface 45 of the fretboard 43. A channel 78 is formed in the bottom portion 32,34 between the base 76 of the neck 22 and a cavity 79 used to house electrical control circuitry 80 (described more fully below). The light source 74 is connected to the electrical control circuitry 80 via shielded wiring 81 that is positioned in the channel 78.

Figure 8:
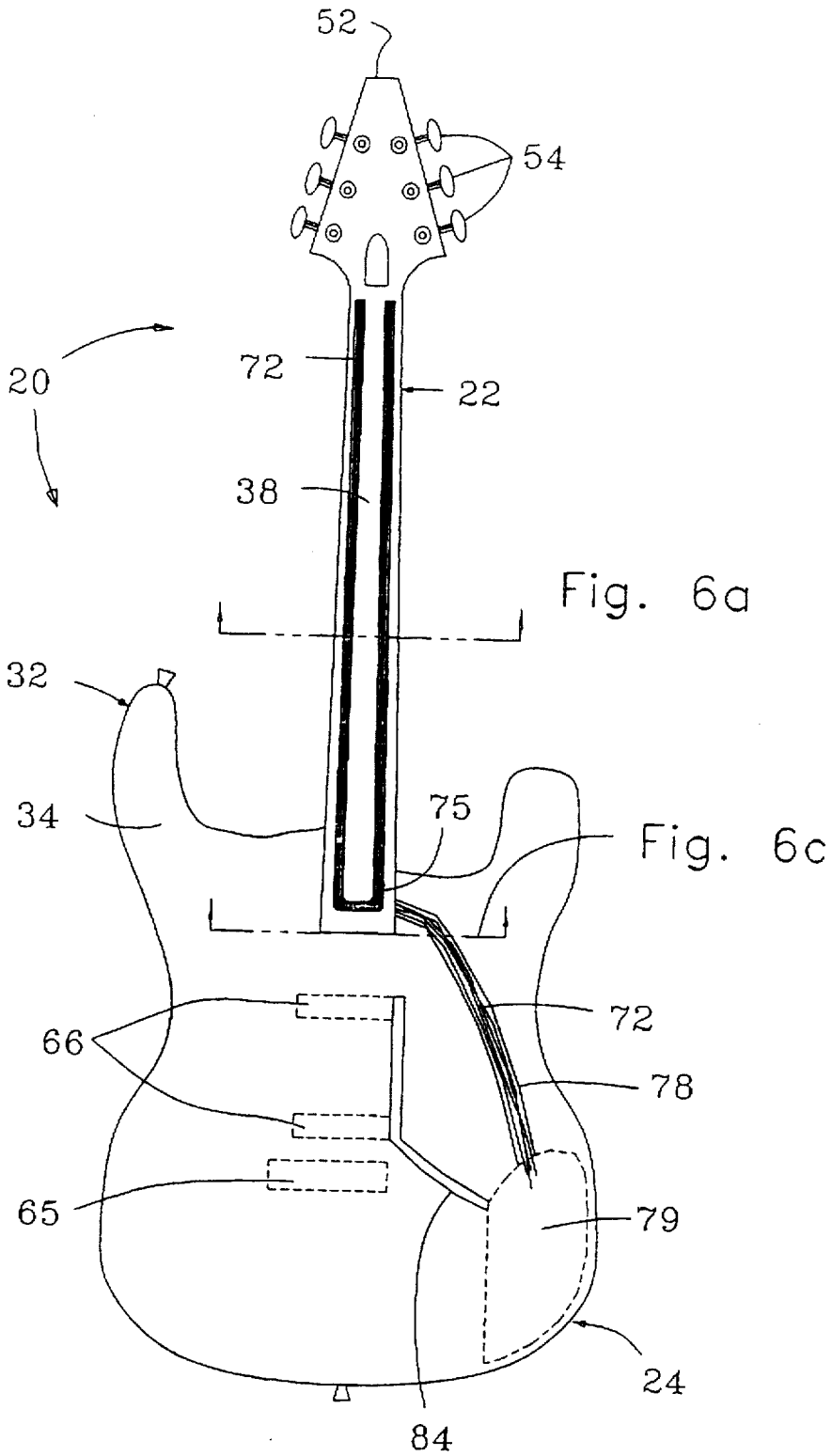
FIG. 8 (6*a* & 6*c*) for through neck construction.
Figure 9:
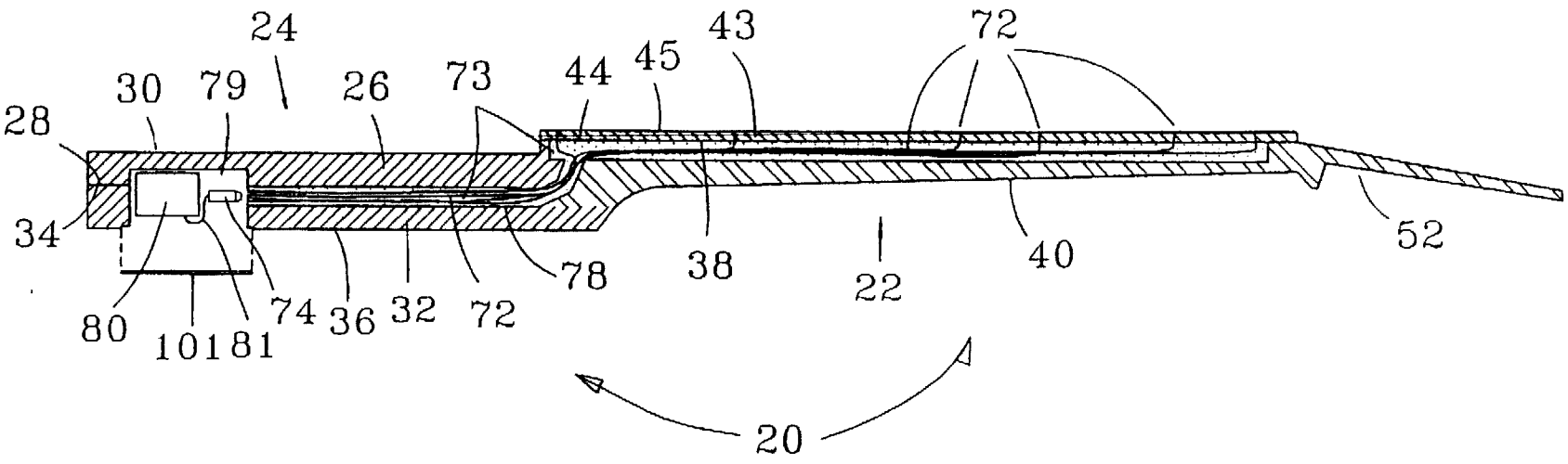
FIG. 9 is a cross sectional view of a fiberoptically illuminated guitar having an illuminated fretboard and a through neck construction.

FIG. 8 is a top view of the a guitar assembled using a through neck construction with the top portion 26 and fretboard 43 removed for illustrative purposes. FIG. 9 is a cross-sectional view that further illustrates the configuration of a guitar assembled using through neck construction. Through neck construction employs the same procedures as discussed above with respect to the bolt on neck construction for positioning and securing the fiberoptics in the longitudinal groove 75 formed in the neck 22 when the fretboard 43 and neck 22 are epoxied or glued together. The fiberoptics 72 extending from the exterior surface 45 of the fretboard 43 are sanded, terminated and faceted using standard guitar 20 manufacturing techniques to shape the neck 22 and fretboard 43. The fiberoptics 72 that terminate on the exterior surface 45 of the fretboard 43 are then faceted (FIG. 3C). After sanding, the fret wires 46 are pressed into their mating slots and the neck 22 and fretboard 43 are properly formed using standard guitar 20 manufacturing techniques.

However, the fiberoptics 72 extending from the base 76 of the neck 22 are not terminated and faceted when through neck construction is used. Instead, the fiberoptics 72 are bundled together and positioned within the channel 78 extending from the base 75 of the neck 22 to the future site of cavity 79 as shown in FIG. 8. The fiberoptic bundle 72 is terminated and faceted when the cavity 79 is routed at a subsequent time during the manufacturing process. A light source or bulb 74 is positioned inside this cavity 79 so as to be in close proximity to (or butted up to) this faceted fiberoptic bundle 72. The light rays emitted from the light source 74 is transmitted or guided to the exterior surface 45 of the fretboard 43 via the fiberoptics 72 so as to illuminate the fretboard 43.

To assemble the body 24 of the guitar 20, an epoxy or wood glue 73 is generously spread over the interior surface 28 of the top portion 26 and the interior surface 34 of the bottom portion 32 of the body 24 to fill any voids, and then the top portion 26 and bottom portion 32 are bonded together. When fibers 72 are used to illuminate the top portion 26, the top portion 26 is impregnated with fibers 72 prior to bonding the top and bottom portions together. A fiberoptically impregnated top portion is illustrated in FIGS.

Figures 10A, 10B:
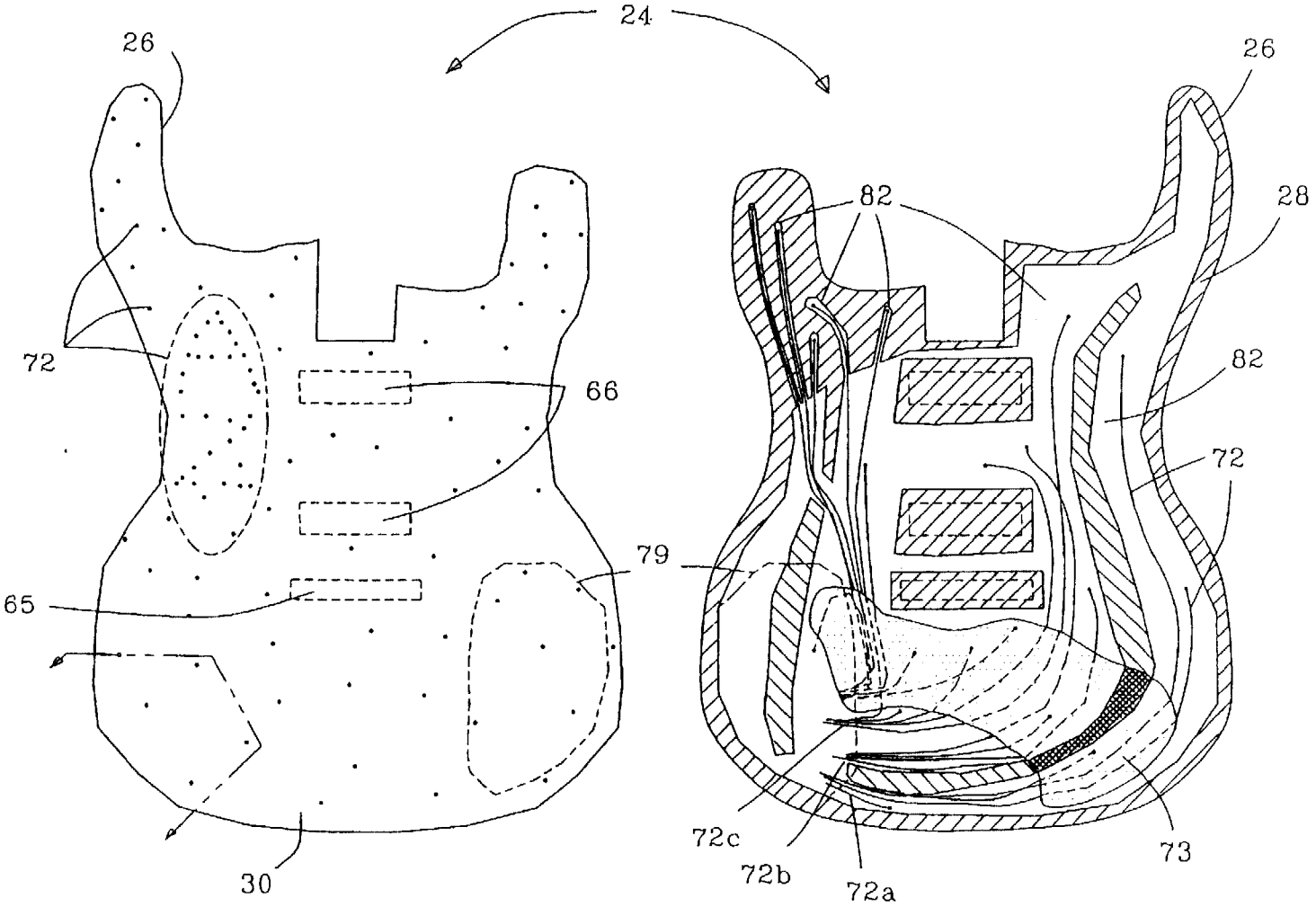
FIG. 10A is a top view of the top portion of a guitar body having a plurality of fibers embedded therein.
FIG. 10B is a bottom view of the top portion of the guitar body set forth in FIG. 10B illustrating the placement of the fibers within the recess formed in the top portion.

10A, 10B and 11. As shown in FIG. 10B, each fiber 72 extends from one of the holes 70 to the future location of a light source 74 which will be disposed in the cavity 79 at a later time during the manufacturing process. The fibers 72 are bundled together at the future location of the light sources 74 within the cavity 79 as shown in FIG. 10B. It is possible to group the fibers 72 into only one bundle or into several bundles. The number of light sources 74 used to illuminate the guitar 20 corresponds to the number of bundles entering the cavity. For example, if three bundles designated as 72*a*, 72*b*, and 72*c* enter the cavity 79 as shown in FIG. 10B, one light source 74*a*, 74*b*, or 74*c* is butted up to each bundle. This configuration allows for light sources which emit varying colors to be used to illuminate different areas of the guitar 20. Alternatively, only one light source 74 may be used to illuminate both the fretboard 43 and the body 24 when through neck construction is used. The optical fibers 72 in each bundle are preferably optically and mechanically isolated such that each fiber 72 provides a separate transmission channel. However, the fibers 72 in each bundle alternatively can be unbuffered and used to provide a single transmission channel.

The interior surface 28 of the top portion 26 is routed out to provide a recess 82 in which the fibers 72 are placed (see FIG. 11). The fibers 72 are then secured in place by a protective coating 73 such as epoxy or glue. The entire recess 82 is filled with the fiber and coating combination such that the overall thickness of the top portion 26 remains constant, regardless of whether the top portion is impregnated by the fibers 72. Epoxing or gluing these fiberoptics 72 to the interior surface 28 of the top portion 26 of the body 24 (as indicated by reference numeral 73) covers, fills in voids, protects and encapsulates the fibers 72, thereby eliminating the risk of their breakage during the remainder of the manufacturing processes.

Before the interior surfaces 28 and 34 of the top and bottom portions 26 and 32 are epoxied or glued together (as indicated by reference numeral 73), a passage 84 is machined or bored in the interior surface 34 of the bottom portion 32 between cavities 66, which can be machined later to contain the pickups 58 and the future location of the cavity 79 (see FIGS. 5 and 8). This passage 84 is used to contain wiring 86 connecting the control circuitry 80, 96 to the pickups 58. The wires 86 from the pickups 58 are placed in the passage 84 as the top and bottom portions 26 and 32 are epoxied or glued together.

After body 24 is assembled and the glue or epoxy hardens, the body 24 is trimmed into the desired shape and thickness using standard sanding and shaping techniques well know in the industry. The fiberoptics 72 protruding from the exterior surface 30 of the top portion 26 are sanded off thus creating a facet, using standard wood working sandpaper or equipment familiar to those skilled in the art of guitar manufacturing. The cavity 79 that will house the electronic circuitry 80 and 96, is routed or cut through the bottom portion 32 into the top portion 26 as shown in FIG. 2 using standard equipment familiar to those in the art of guitar manufacture. This cavity 79 can be formed using a standard high speed router. This process of forming the cavity 79 does not have to be changed in any manner from the processes currently used in guitar 20 manufacturing. The fiberoptic bundles 72 extending into the cavity 79 are cut and faceted during this routing process. The faceting of the fibers 72 in the bundle is accomplished using standard wood working machining and finishing equipment that currently is employed on established production lines. This process eliminates the need for special cleaving processes to be performed on each fiber 72 in the bundle for light to be emitted into or out of the fiber 72.

After the top and bottom portions 26 and 32 are secured together, a grain sealer 88 is applied to the entire exterior surface of the guitar 20 and guitar body 24. The exterior surfaces 30, 36 of the body 24 are then sanded to a finish using standard surface preparation techniques known to those skilled in the art of guitar 20 manufacturing. A standard clear lacquer finish 89 is then applied in multiple coats to the exterior surface of the guitar body 24. After the clear lacquer finish 89 has set, it is brought to a high polish. Since the lacquer 89 is transparent, the light emitted by the fiberoptics 72 from the top portion 26 of the body 24 is transmitted through the lacquer 89 and visible to the human eye.

Figure 12:
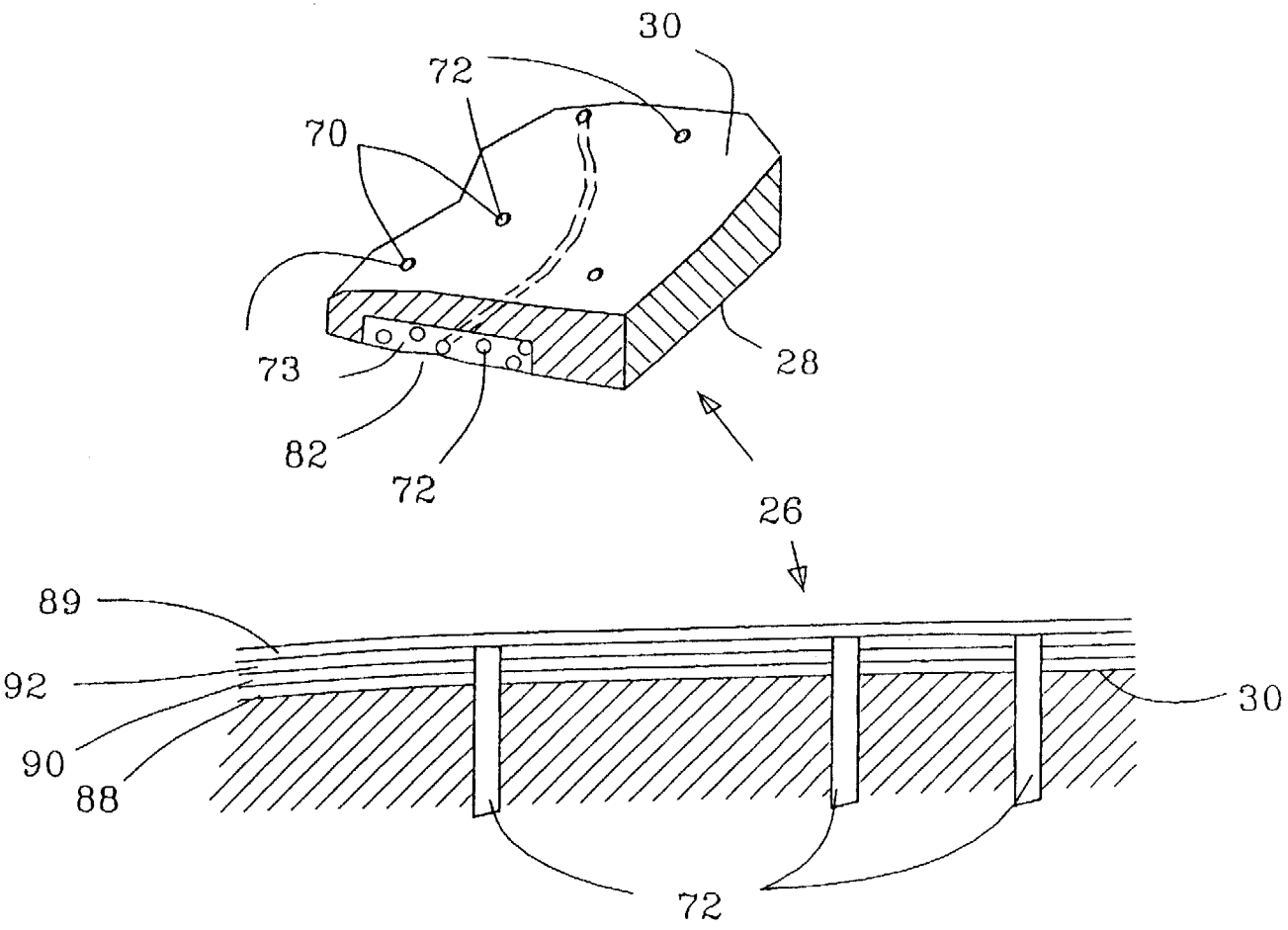
FIG. 12 is a sectional view of the fiberoptically impregnated top portion of guitar body as shown in FIG. 10A illustrating the protective and decorative paint and finishes used on the exterior surface of the body of the guitar.

If the exterior surface 30 of the top portion 26 of the guitar body 24 is painted to provide an opaque decorative finish and the fiberoptics 72 are used to illuminate the guitar body 24, a coat of paint 90 is applied to the exterior surface 30 of the top portion 26 before the holes 70 for the fiberoptics 72 are drilled. This prevents the paint 90 from covering or blocking the light emitted from the fibers 72. In this situation, the top portion 26 is sanded and shaped into the desired finished form prior to applying the paint 90 to the exterior surface 30. The shaping of the body 24 can be achieved by temporarily bonding the interior surfaces 28 and 34 of the top and bottom portions 26, 32 together until they are properly shaped in the desired finished form. After the paint 90 dries, a thick clear coating of lacquer 92 is applied to the exterior surface 30. This thick clear coating 92 protects the painted surface when the fiberoptics 72 extending from the exterior surface 30 are sanded later in the assembly process. After the top and bottom portions 26 and 32 are permanently secured together, the exterior surface 36 of the bottom portion 32 is painted to blend in with the exterior surface 30 of the top portion 26. When the guitar 20 is assembled and the fiberoptics 72 are sanded to create smooth exterior surfaces 30, 36, the clear lacquer finish 89 is applied to the exterior surfaces as discussed above using standard guitar 20 construction techniques familiar to those skilled in the art (see FIG. 12).

After the electronics cavity 79 is routed out and the fiberoptics 72 are faceted, at least one light source 74 is installed in the cavity 79. The light source 74 is preferably a miniature lensed lamp or a miniature parabolic mirrored high intensity lamp. The light source 74 emits a radiant energy within the region of the visible electromagnetic spectrum. The light source 74 is positioned such that the light rays are normal to the facet of the fiberoptic bundle 72. The intensity of the light emanating from the light source 74 can be modulated by the electrical signals generated by the pickup coils 58. This electrical signal can be modified and amplified in many ways familiar to those skilled in the art. In addition, the fibers 72 can be selectively bundled into two or more groupings as discussed above with respect to FIG. 10B such that certain regions of the guitar 20 emit light rays of varying times and colors. For example, the color of the light rays emitted by each light source 74 can vary such that the fibers 72 used to illuminate the fretboard 43 emit a blue light while the fibers 72 illuminating the body 24 emit a red light.

Standard guitar electronic circuitry 96 used for operation of the electric guitar 20 is positioned within the cavity 79. A battery or power supply 97 located in a cavity 98 formed in the body of the guitar 20 supplies direct current (DC) power to the power circuitry 97 and light control circuitry 80. The battery 97 is preferably a 6 volt or so NiCad DC battery. A shielded cable 99 positioned in a groove (not shown) routed through the guitar body 24 is used to connect the battery 97 to the circuitry 80. A protective shield 100 is secured to the exterior surface 36 of the bottom portion 32 over the cavity 98 used to house the battery 97 after the battery 97 is installed as shown in FIG. 1B.

The light control circuitry 80 used to control the operation of the guitar 20 and the illumination of the light source 73 is also positioned inside the cavity 79, preferably on the same circuit board containing the standard guitar circuitry 96. After installation of the standard guitar circuitry 96 and light control circuitry 80, and the light source(s) 74, a protective shield 101 is secured to the exterior surface 36 of the bottom portion 32 as shown in FIG. 1B.

When the guitar 20 is played by a musician, the vibration of the strings 56 interrupt the electromagnetic fields of the pickups 58 through which the strings 56 pass. This interruption or change in the electromagnetic fields cause a change in the electrical energy passing through the pickup 58. The pickups 58 convert the mechanical energy changes into electrical signals. The electrical signals from the pickups 58 are then transmitted to the light control circuitry 80 and standard guitar circuitry 96 associated with the guitar 20 via wiring 86.

Figure 13:
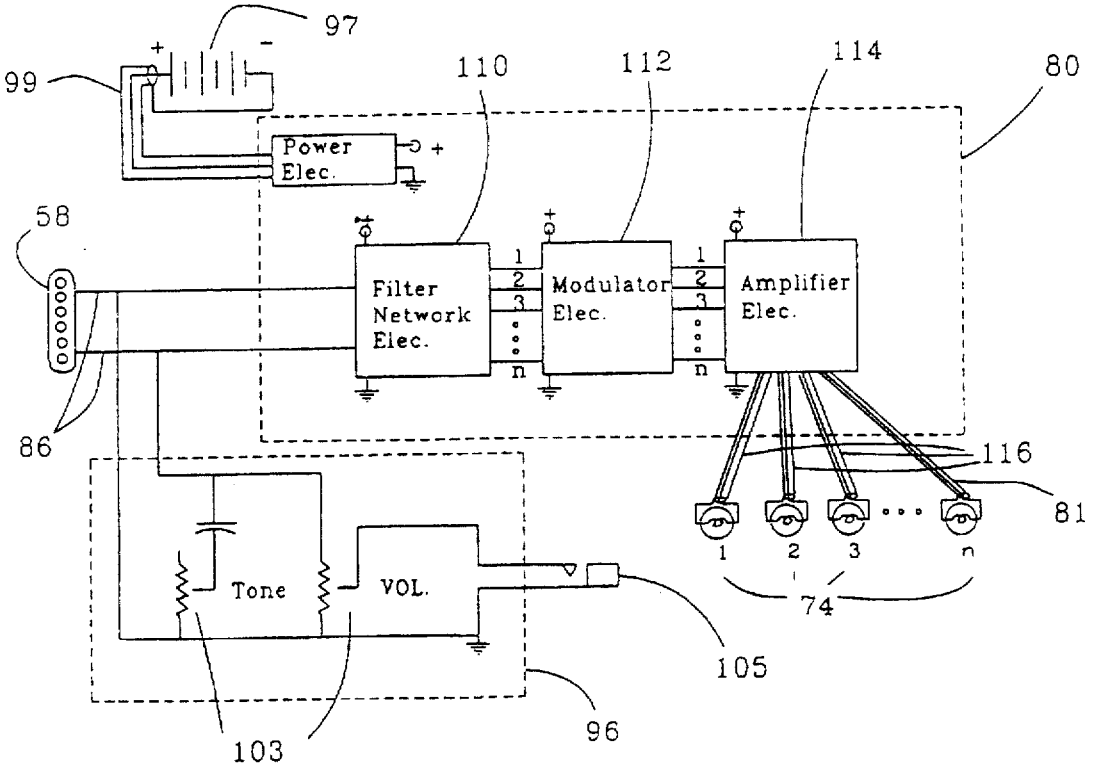
FIG. 13 is a schematic diagram of the power electronic circuitry, the light source control circuitry, and the tone and volume control circuitry employed in operating the fiberoptically illuminated guitar of the present invention.
Figure 14:
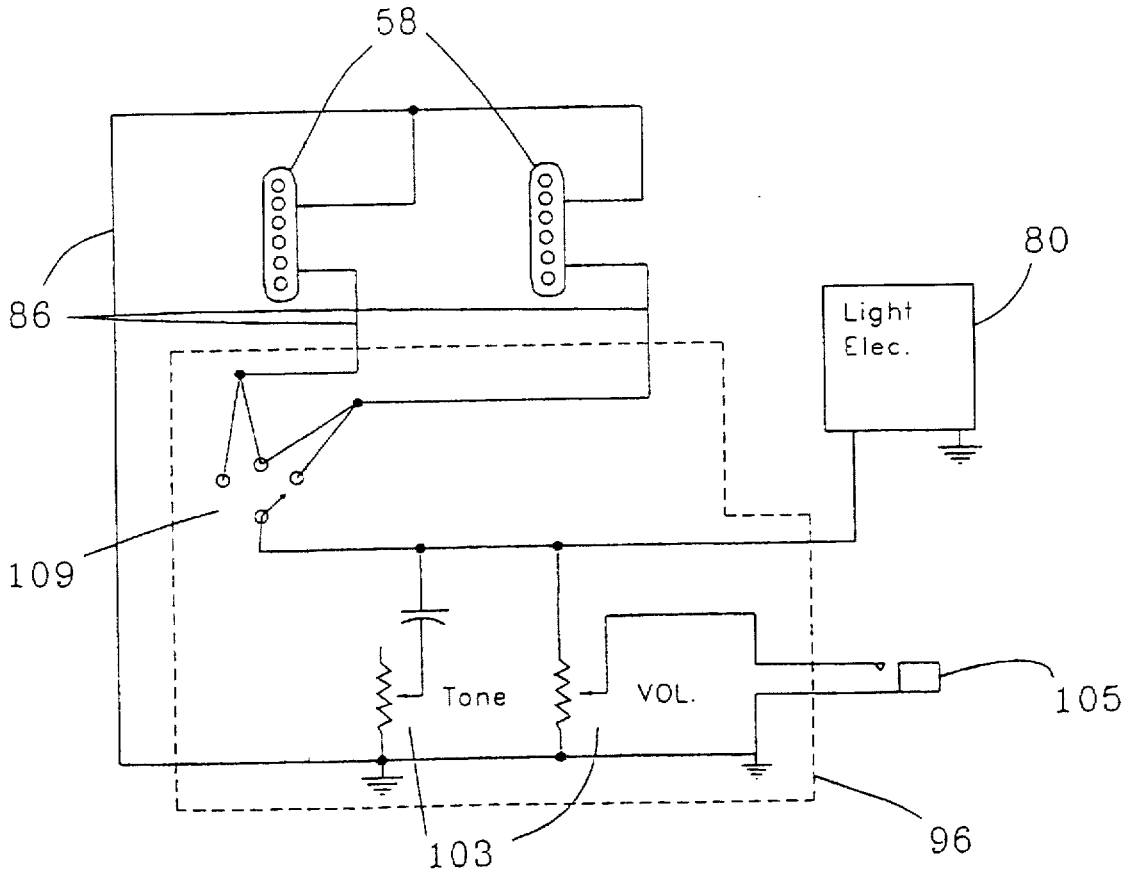
FIG. 14 is a schematic diagram of the tone and volume control circuitry of FIG. 13 when two pickups are employed in the construction of the fiberoptically illuminated guitar.

The standard guitar circuitry 96 includes two circuits, namely a tone and volume control circuit 103 and a light source control circuit 80 connected in parallel. FIG. 13 illustrates the control circuitry 80 configuration for a guitar 20 having a single pickup 58. The output from the pickup 58 is sent to both the tone and volume control circuit 103 and the light source control circuit 80. The tone and volume control circuit 103 represents a standard circuit configuration well known to those skilled in the art. The circuit 103 includes a series combination of a capacitor C1 and a potentiometer ("pot") resistor or rheostat P1 connected in parallel with a second pot resistor P2. The output voltage $V_{out}$ is transmitted via a cable 105 to speakers (not shown) which emit an audible sound wave. When two pickups 58 are used in the guitar assembly, the tone and volume control circuitry is configured as shown in FIG. 14 to a three way guitar selector switch SW1. As shown in FIG. 1A, a control knob 108*a*, 108*b*, and switch 109 positioned on the exterior surface 28 of the top portion 26 is operatively connected to each pot resistor 103. Knobs 108*a* and 108*b* are used to manually adjust the tone and volume by varying the resistance of the pot resistors 103.

As shown in FIG. 13, the output of the pickup 58 is also transmitted to the light source control circuit 80. Specifically, the pickup output is supplied through a filter network 110, and a modulator circuit 112 of conventional design to an electrical amplifier 114, which powers light source(s) 74.

To summarize, the output of the pickup 58 is transmitted to a filtering and amplification network 110 associated with the light source control circuit 80 for filtering and amplification. The number of output signals generated by the filtering and amplification network 110 directly corresponds to the number of internal light sources 74 used to illuminate the guitar 20. For example, if "n" light sources 74 are employed as illustrated in FIG. 13, then "n" filtered and amplified output signals are generated by the circuitry 110. The filtering and amplification network 110 may include a low pass, band pass or high pass filter depending upon the configuration of the light source control circuit 80.

Each output signal from the filtering and amplification network 110 is transmitted to modulation network 112. The modulation network 112 dynamically modulates each signal such that certain characteristics of the signal are varied or selected in accordance with a modulating function. In other words, the modulation network 112 allows for controlled variation of each input signal. The modulation network 112 generates a modulated output signal corresponding to each input signal it received.

Each modulated signal is then transmitted to a transistor switching network 114 used to turn the light sources(s) 74 on or off. The transistor switching network 114 controls the illumination of each light source 74 based upon the modulated signal. The network 114 generates an output signal corresponding to each modulated signal which is then transmitted to a particular light source 74 via a shield wire 116 (and/or wiring 81 for bolt on neck construction) as shown in FIG. 13. When the light source 74 is illuminated by network 114, the guitar 20 is illuminated via the fiberoptics 72 which terminate at that light source 74.

The foregoing description is set forth only for illustrative purposes only and is not meant to be limiting. Numerous variations, within the scope of the appended claims will be apparent to those skilled in the art in light of the foregoing description and accompanying drawings.

Having thus described the invention, what is claimed and desired to be secured by Letters Patent is:

1. A stringed musical instrument having a body, a neck, and at least one electrical pickup, comprising:

at least one light source disposed within the body of said musical instrument;

control circuitry, housed within the body of said musical instrument, connected to said pickup and said light source, for selectively controlling the illumination of said light source based upon electrical signals generated by the pickup; and a plurality of optical fibers structurally bonded along their lengths within said musical instrument and attached to a top portion inside the musical instrument, having a first end disposed in close proximity to said light source, and a second end positioned at a predetermined location on an exterior surface of said musical instrument, said fibers strengthening said musical instrument and providing a fixed transmission path for the light emitted from the light source to the exterior surface of the musical instrument.

2. The stringed musical instrument of claim 1 wherein the second end of each fiber extends through said fretboard at a predetermined location.

3. The stringed musical instrument of claim 1 wherein the second end of each fiber extends through a top surface of the body at a predetermined location.

4. The stringed musical instrument of claim 1 wherein said fibers are grouped into at least two independent bundles such that a first bundle is used to illuminate the fretboard and a second bundle is used to illuminate the body, the first end of each fiber in a bundle disposed apart from the first end of each fiber in a second bundle.

5. The stringed musical instrument of claim 4 wherein two light sources emitting differing colors of light are disposed within the body, each light source being disposed in close proximity to one of the two bundles such that the fretboard and body are illuminated by differing colors of light.

6. The stringed musical instrument of claim 1 wherein a plurality of light sources of differing colors are used to illuminate the exterior surface of said musical instrument, one end of each fiber being selectively positioned in close proximity to one of said light sources.

7. An electric guitar, comprising:

an opaque body having a top surface and a bottom surface;

a neck extending outwardly from the body having an interior surface with a longitudinal groove formed therein and an exterior surface;

an opaque fretboard having an exterior surface and an interior surface mounted on the interior surface of the neck, said fretboard having a plurality of holes formed therein extending inwardly from the exterior surface to interior surface;

at least one light source disposed within said body;

a plurality of optically conductive fibers structurally bonded along their lengths and attached to a top portion inside the guitar within said guitar, each fiber extending through one of the holes in the fretboard, along the groove in said neck and through the body, terminating in close proximity to said light source such that each fiber strengthens said guitar and transmits light emitted by the light source to the exterior surface of the fretboard;

at least one pickup disposed within the body; and control circuitry disposed in a cavity formed in the body, connected to said light source and said pickup, for controlling the illumination of the light source based upon electric signals generated by said pickup.

8. The electric guitar as set forth in claim 7 wherein said light source is disposed in the cavity containing the control circuitry.

9. The electric guitar as set forth in claim 7 wherein a plurality of light sources of differing colors are used to illuminate said fretboard, said light sources being disposed in the cavity containing said control circuitry, one end of each fiber being selectively disposed in close proximity to one of said light sources.

10. The electric guitar as set forth in claim 7 wherein said fibers terminate in the vicinity of a base of said neck where said neck attaches to said body, said light source being disposed in close proximity to the base of said neck inside a cavity formed in the body of the guitar.

11. The electric guitar as set forth in claim 8 further including a plurality of optically conductive fibers extending from the light source through the body to a plurality of predetermined locations on the top surface of the body.

12. The electric guitar as set forth in claim 11 wherein said body includes a top portion and a bottom portion, said top portion having a plurality of holes drilled inwardly therethrough, said fibers extending from the light source through the holes to the top surface of the top portion of the body, the top surface of said body being illuminated via the fibers when said light source is illuminated.

13. The electric guitar as set forth in claim 11 wherein a plurality of light sources of differing colors are used to illuminate the top surface of said body, said light sources being disposed in the cavity containing said control circuitry, one end of each fiber being selectively disposed in close proximity to one of said light sources.

14. The electric guitar as set forth in claim 11 wherein any portion of said fibers extending outwardly from said guitar are sanded and faceted to obtain a smooth exterior surface for the guitar.

15. A method of illuminating an electric guitar having a body, at least one electrical pickup mounted to the body, a neck extending outwardly from the body, and a fretboard secured to and supported by the neck, comprising the steps of:

disposing a plurality of optical fibers along predetermined internal paths extending from a cavity formed in the body of the guitar to predetermined locations on an exterior surface of said electric guitar;

filling the voids in the internal paths and between the optical fibers with a bonding agent;

mounting a light source inside the cavity in close proximity to the fibers; and providing means for selectively illuminating said light source based on the electric signal generated by the pickup to thereby illuminate the exterior surface of the guitar via the optical fibers.

16. The method of illuminating an electric guitar as set forth in claim 15, further including terminating and faceting portions of said optical fibers extending from the exterior surface of said guitar when said guitar is sanded and shaped (during standard guitar manufacturing procedures).

17. The method of illuminating an electric guitar as set forth in claim 15, further including terminating and faceting said optical fibers at the cavity when the cavity is routed out (during standard guitar manufacturing procedures).

18. The method of illuminating an electric guitar as set forth in claim 15, further including illuminating the exterior surface of the guitar with at least two colors of light simultaneously by selectively grouping said optical fibers into at least two bundles, positioning the bundles at different locations in the cavity, and mounting a light source inside the cavity in close proximity to each of the bundles such that each light source emits a different color of light.

19. A method of illuminating an electric guitar having a body including a top portion and a bottom portion, at least one electrical pickup, a neck extending outwardly from said body, and a fretboard secured to and supported by said neck, comprising the steps of:

drilling a first set of holes between an exterior surface and interior surface of the top portion of the guitar body;

drilling a second set of holes between an exterior surface and interior surface of the fret board;

threading an optically conductive fiber through each of the first and second sets of holes;

securing the fibers within each hole;

gathering the fibers extending through the first set of holes into a bundle at a future location of a cavity in the body;

gluing the fibers extending through the first set of holes to the interior surface of the top portion;

placing the second set of fibers in a groove formed in the neck of the guitar as the neck and fretboard are secured together;

filling the groove with a bonding agent to fill the voids between the fibers and the voids between the fibers and the groove to form a composite material;

placing the second set fibers extending from a base of neck into a channel formed in an interior surface of the bottom portion of the body that extends from the base of the neck to the future location of the cavity in the body;

filling the channel with a bonding agent to fill the voids between the fibers of the second set and the voids between the second set of fibers and the channel to form a composite material;

bonding the interior surfaces of the top and bottom portions together;

routing out the cavity through the bottom portion into the top portion;

terminating and faceting a first end of each fiber embedded within the body of the guitar when the cavity is routed out;

terminating and faceting a second end of each fiber extending outwardly from the top portion and fretboard by sanding the exterior surface of the guitar to obtain a smooth exterior surface;

mounting at least one light source inside the cavity in close proximity to the terminated fibers; and mounting light source control circuitry inside the cavity and connecting input terminals for the control circuitry to the electrical pickup and output terminals for the control circuitry to the light source whereby said control circuitry controls the illumination of the light source based upon the electric signal generated by the pickup.

20. The stringed musical instrument of claim 4 wherein a plurality of light sources emitting light are disposed within the body, each light source being disposed in close proximity to a separate bundle, the number of light sources corresponding to the number of bundles.

* * * * *